US008713831B2

(12) United States Patent
Grossman et al.

(10) Patent No.: US 8,713,831 B2
(45) Date of Patent: May 6, 2014

(54) OFF-TRIGGER LOCATOR AND GUIDE PATH FOR A FIREARM

(75) Inventors: David A. Grossman, Mascoutah, IL (US); Jonathon D. Grossman, Mascoutah, IL (US)

(73) Assignees: David A. Grossman, Mascoutah, IL (US); Jonathon D. Grossman, Mascoutah, IL (US)

( * ) Notice: Subject to any disclaimer, the term of this patent is extended or adjusted under 35 U.S.C. 154(b) by 0 days.

(21) Appl. No.: 13/588,743

(22) Filed: Aug. 17, 2012

(65) Prior Publication Data

US 2014/0047749 A1 Feb. 20, 2014

(51) Int. Cl.
*F41C 23/00* (2006.01)
*F41C 23/08* (2006.01)

(52) U.S. Cl.
USPC ..... 42/1.01; 42/85; 42/71.02; 42/71.01; 42/106

(58) Field of Classification Search
USPC ..... 42/1.01, 70.01, 71.01, 71.02, 85, 104, 42/106; 434/16
See application file for complete search history.

(56) References Cited

U.S. PATENT DOCUMENTS

| | | | | |
|---|---|---|---|---|
| 694,969 | A | 3/1902 | Kemp | |
| 1,475,037 | A * | 11/1923 | Thimgren | 42/69.01 |
| 2,270,707 | A | 1/1942 | Humski | |
| 4,476,644 | A * | 10/1984 | Laing | 42/70.01 |
| 4,601,123 | A * | 7/1986 | Swearengen et al. | 42/72 |
| 5,515,636 | A * | 5/1996 | McGarry et al. | 42/117 |
| 5,560,133 | A * | 10/1996 | Kuebler | 42/69.01 |
| 5,654,594 | A | 8/1997 | Bjornsen, III et al. | |
| 6,363,647 | B2 | 4/2002 | Kaminski | |
| 6,860,053 | B2 * | 3/2005 | Christiansen | 42/71.02 |
| 7,786,397 | B2 * | 8/2010 | Dick | 200/332.2 |
| 8,132,352 | B2 * | 3/2012 | Lippard | 42/111 |
| 8,181,378 | B2 * | 5/2012 | Losinger | 42/85 |
| 2002/0170224 | A1 | 11/2002 | Lawless | |
| 2002/0194767 | A1 | 12/2002 | Houde-Walter et al. | |
| 2004/0216348 | A1 * | 11/2004 | McMoore | 42/70.07 |
| 2005/0229457 | A1 | 10/2005 | McGarry | |
| 2006/0156608 | A1 | 7/2006 | Kellermann et al. | |
| 2010/0225064 | A1 * | 9/2010 | Deatherage, Jr. | 273/405 |
| 2010/0263254 | A1 * | 10/2010 | Glock | 42/71.02 |
| 2011/0047847 | A1 * | 3/2011 | Hughes et al. | 42/1.01 |
| 2011/0138667 | A1 * | 6/2011 | Bolden | 42/1.01 |
| 2012/0141957 | A1 | 6/2012 | Miller | |

OTHER PUBLICATIONS

KSC M17, Sep. 19, 2011, www.north-texas-airsof t.org/wiki/index.php?title=KSC_M17&oldid=1511.*

* cited by examiner

*Primary Examiner* — Bret Hayes
*Assistant Examiner* — Derrick Morgan
(74) *Attorney, Agent, or Firm* — Thompson Coburn LLP

(57) ABSTRACT

A firearm has an off-trigger locator and/or guide path. The off-trigger locator may be a depression or a convexity formed on a side of a frame of the firearm adjacent a trigger of the firearm, and may further include a raised portion. The off-trigger locator is configured to allow a user of the firearm to move between the off-trigger locator and the trigger, as necessary, for instance, as the user goes between non-firing and firing conditions. The guide position may comprise a groove or raised ridge formed on a frame of the firearm adjacent a trigger of the firearm and extending from the frame of the firearm into a trigger area adjacent the trigger. The guide path is configured to allow the user to move along the guide path away from and into the trigger area, as necessary, for instance, as the user goes between non-firing and firing conditions.

2 Claims, 5 Drawing Sheets

OFF-TRIGGER LOCATOR AND GUIDE PATH FOR A FIREARM

BACKGROUND

The following disclosure relates to an aid to assist a user in using a firearm. Specifically, the disclosure relates to an off-trigger locator and guide path that assist the user in locating and guiding the user's trigger finger between non-firing and firing conditions.

DETAILED DESCRIPTION

Figure 1:
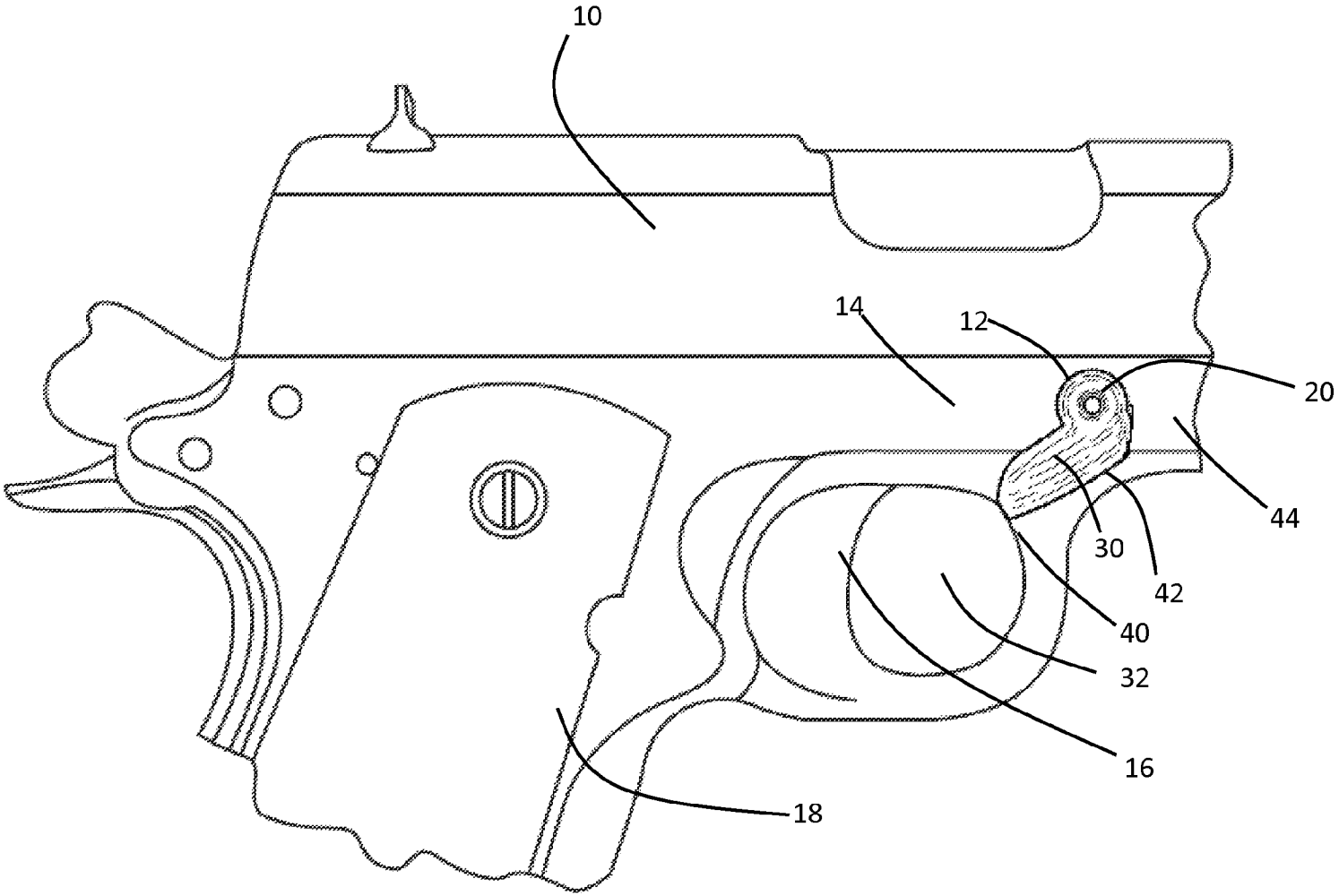
FIG. 1 is a side view of a fire arm comprising a hand gun with an off-trigger locator and guide path located on a right side of the hand gun.

With reference to the drawings, a firearm 10 comprising a hand gun has an off-trigger locator 12 applied to a frame 14 of the firearm to assist the user in locating the user's trigger finger in a non-firing and firing condition. In a non-firing condition, the user may place the user's finger on the off-trigger locator 12 rather than a trigger 16 of the firearm. Thus, the user may use the off-trigger locator 12 as a reference point rather than another location in a non-firing condition. This may prove useful in many scenarios. For instance, during training, a user may be instructed to place the user's finger on the off-trigger locator to provide a visual indication to the trainer that the user is in a non-firing condition. Providing the off-trigger locator in standard location on a firearm also facilitates this end by providing a quick visual aid to trainers to see that a user/trainee has complied with instructions to go to a non-firing condition. Also, an off-trigger locator provides a user with an aid to safely operate a firearm in a stressful condition. Because the off-trigger locator is located in close proximity to the trigger, the user may disengage the off-trigger locator and engage the trigger quickly to discharge the firearm. However, the off-trigger locator requires intentional movement by the user to disengage the off-trigger locator and engage the trigger, as opposed to other locations where such movement of the user's trigger finger may be less intentional.

The off-trigger locator 12 is located in a position on the frame 14 of the firearm that allows the user to manipulate the user's trigger finger on the off-trigger locator while the user's trigger finger hand grasps a grip 18 of the firearm. Thus, the user may continue to grasp the grip 18 of the firearm without significant movement of the user's hand as the user's senses the off-trigger locator 12 with the user's trigger finger. However, the off-trigger locator 12 is in a position on the frame 14 of the firearm that allows the user to easily move between the off-trigger locator and the trigger 16, as necessary, for instance, as the user goes between non-firing and firing conditions.

In one embodiment, the off-trigger locator 12 comprises a circular depression which may be formed in the frame of the hand gun. The user may place the user's fingertip in the depression. Because the frame 14 of the handgun adjacent the trigger is generally flat, the circular depression provides a tactile indication for the user to locate the off-trigger locator. The circular depression off-trigger locator may further comprise a raised dot 20 in the center of the circular depression to provide the user with an additional tactile indication to locate the off-trigger locator on the side of the frame of the handgun. In an alternate embodiment, the off-trigger locator may comprise a circular convexity, and may further include a raised dot in the center of the circular convexity to assist the user in finding the circular convexity on the side of the frame of the hand gun. While the off-trigger locator is shown as a circular depression or described as a circular convexity, other shapes besides circles may be used.

In addition to, or in the alternative, the firearm 10 may be provided with a guide path 30 to assist the user in moving the user's trigger finger from the frame 14 of the hand gun to the trigger area 32. The guide path 30 is located in a position on the frame of the firearm that allows the user to manipulate the user's trigger finger on the guide path while the user's trigger finger hand grasps the grip 18 of the firearm. Thus, the user may continue to grasp the grip of the firearm without significant movement of the user's hand as the user's senses the guide path with the user's trigger finger. However, the guide path is sufficiently dimensioned and positioned on the frame of the firearm to allow the user to easily move along the guide path 30 away from and into the trigger area 32, as necessary, for instance, as the user goes between non-firing and firing conditions.

In one embodiment, the guide path 30 may comprise a groove that extends from the frame of the hand gun into the trigger area 32. The groove of the guide path may have a width generally dimensioned to allow a user to sense the groove and follow the groove with the user's trigger finger into the trigger area 32 to engage the trigger 16 of firearm. Depending upon the type of firearm to which the guide path is applied, a portion of the groove may be formed in a trigger guard 40, may be formed in an underside 42 of the frame of the firearm, and/or may be formed on a side 44 of the frame of the firearm. In an alternate embodiment, the guide path may comprise a raised ridge, and may further include a raised ridge with a width generally dimensioned to allow a user to sense the ridge raised above the side of the frame of the firearm and follow the raised ridge with the user's trigger finger into the trigger area to engage the trigger of firearm.

Figure 2:
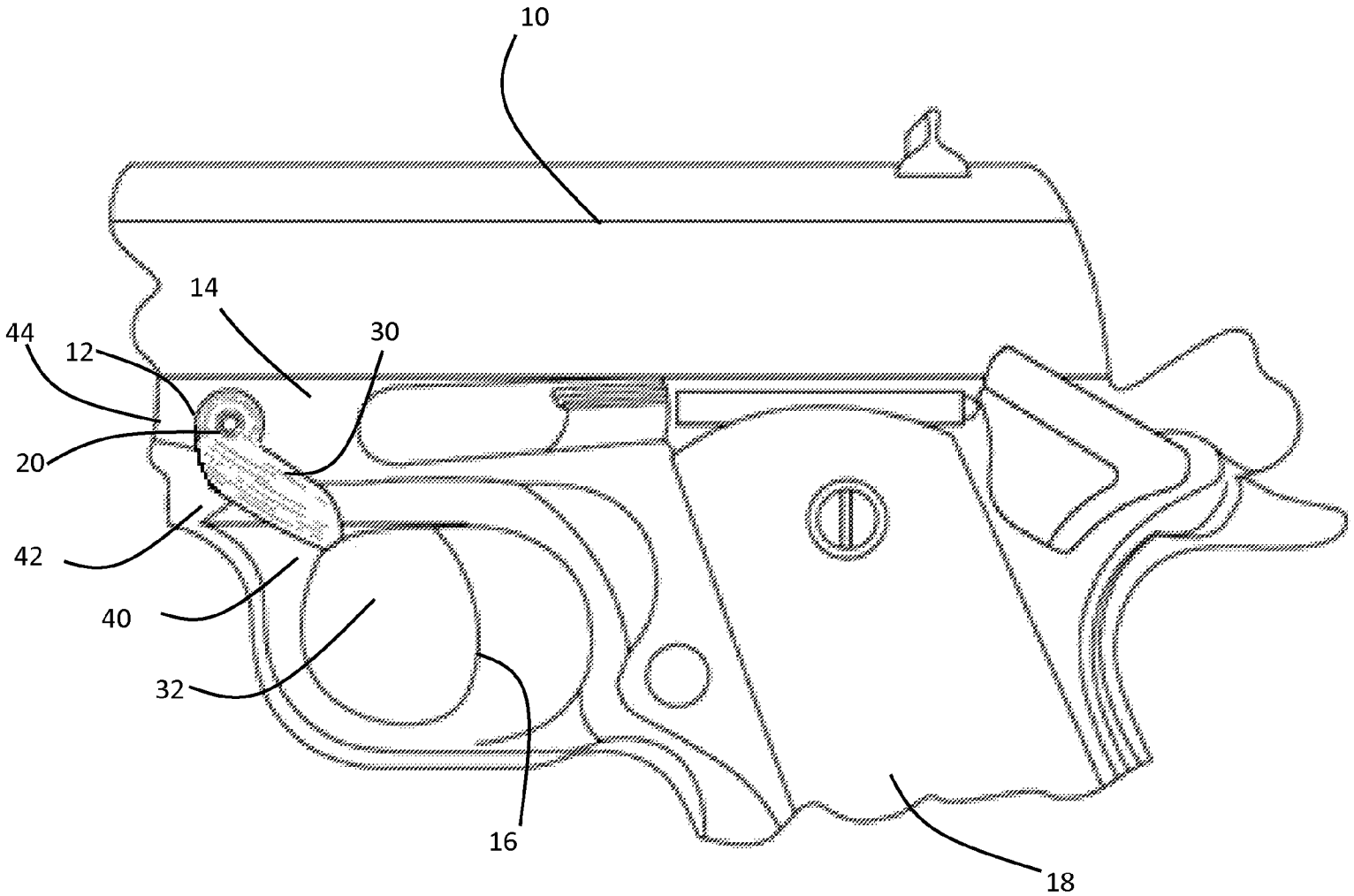
FIG. 2 is an alternate embodiment of a fire arm comprising a hand gun with an off-trigger locator and guide path located on a left side of the firearm.
Figure 3:
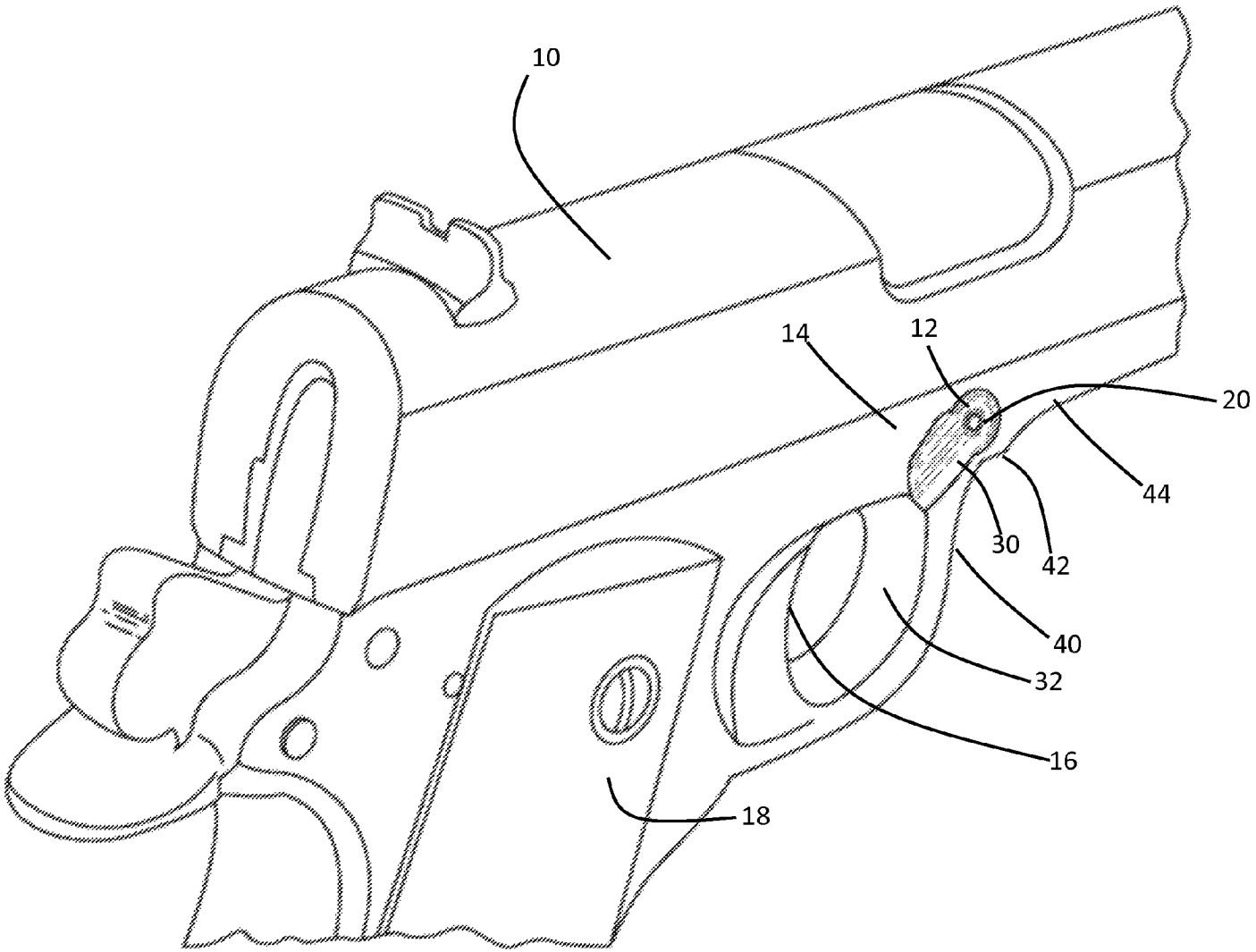
FIG. 3 is a perspective view of the firearm of FIG. 1.
Figure 4:
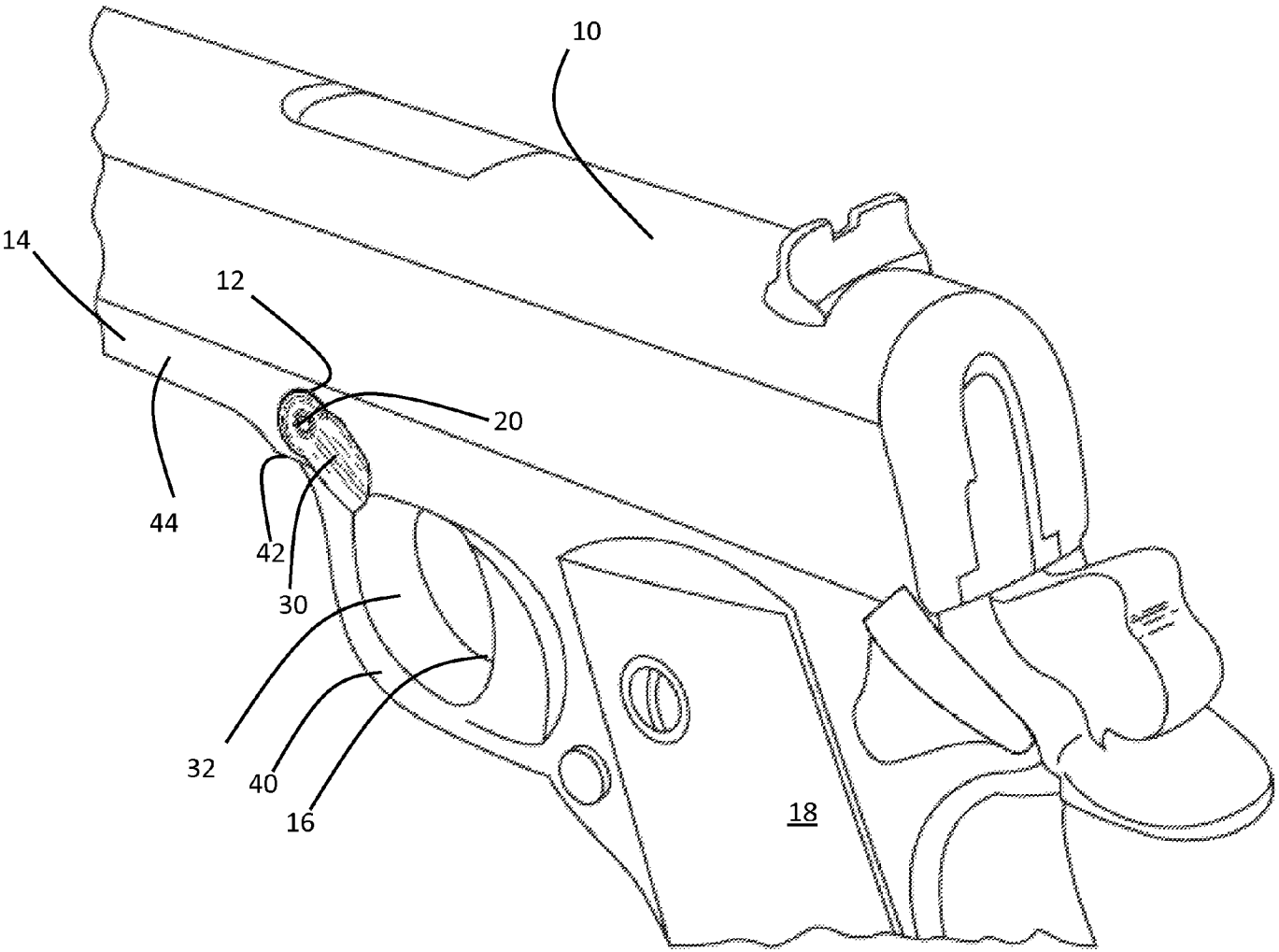
FIG. 4 is a perspective view of the firearm of FIG. 2.

FIG. 1 shows the off-trigger locator 12 and guide path 30 together on the right side of a firearm for a right-hand dominant user. FIG. 2 shows the off-trigger locator 12 and guide path 30 on the left side of the firearm for a left-hand dominant user. The off-trigger locator and guide path may be provided on both sides of a single firearm or the left or right side depending upon the dominant hand of the user. Additionally, it is not necessary that the off-trigger locator and guide path be used together. The off-trigger locator may be provided on either side of the firearm with or without the guide path. Likewise, the guide path may be provided on either side of the firearm as desired without the off-trigger locator.

Figure 5:
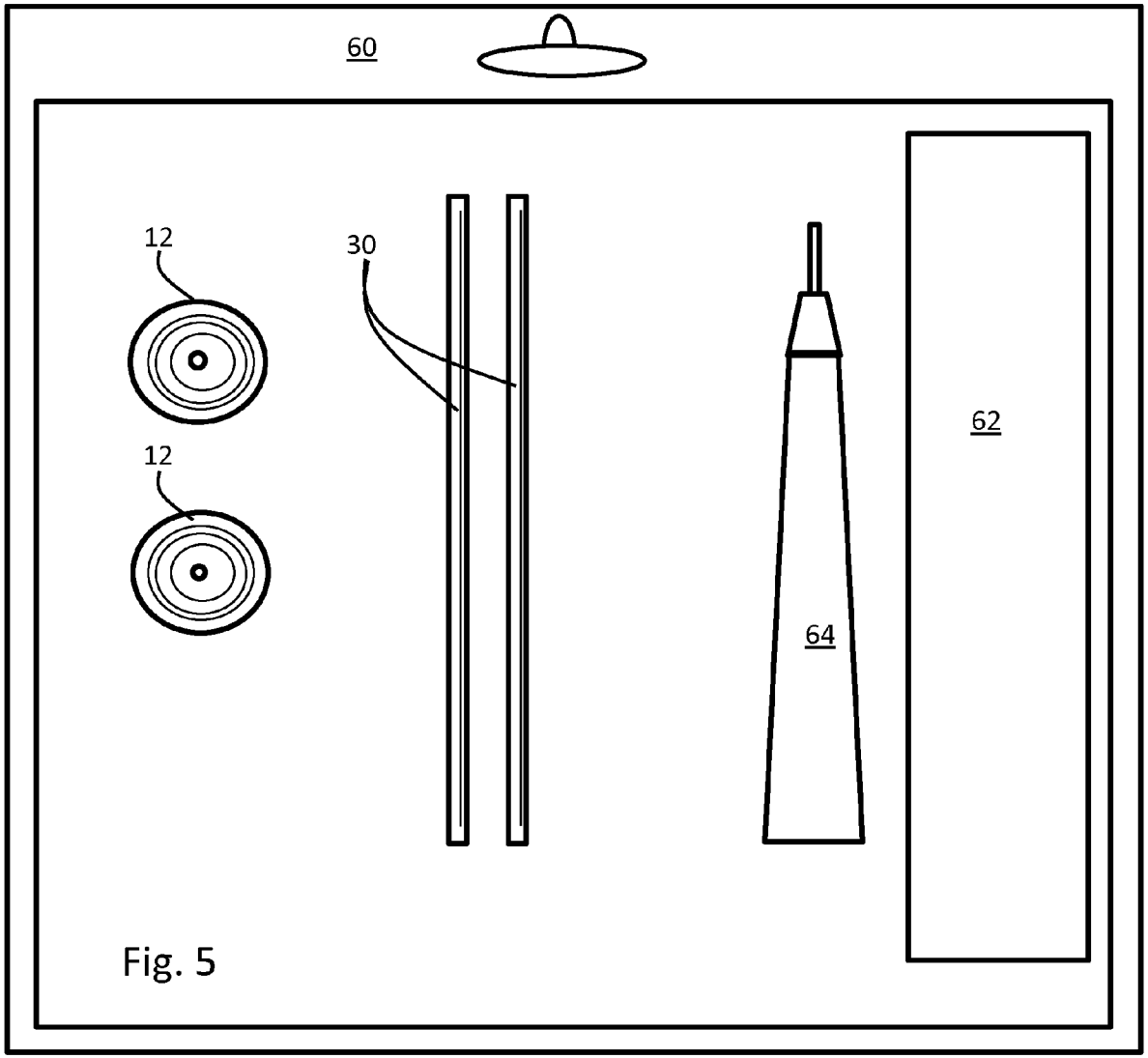
FIG. 5 is a plan view of a kit comprising an off-trigger locator and guide path that may be applied to a firearm.

As shown in FIG. 5, the off-trigger locator 12 may be provided as a kit 60 and/or the guide path 30 may be provided as part of a kit. For instance, the off-trigger locator in the form of a convexity may be provided as a kit to retrofit an existing firearm. The kit may contain instructions or other indicia 62, and other items 64 for applying the convexity of the kit to the firearm. The convexity of the kit may be mechanically attached, welded, soldered, brazed, or otherwise adhered to the firearm. Likewise, the guide path 30 in the form of a raised ridge may be provided as a kit to retrofit an existing firearm. The kit may contain instructions or other indicia 64 for applying the raised ridge guide path of the kit to the firearm. The raised ridge guide path of the kit may be mechanically attached, welded, soldered, brazed, or otherwise adhered to the firearm. The kit show representative configurations of the off-trigger locator and guide path. Other shapes and configurations may be used.

While the drawings show the off-trigger locator as a circle with a circular raised portion, other configurations may also be utilized. While the drawings show the guide path as a groove, other configurations may also be utilized. While the drawings show a handgun, the off-trigger locator and/or guide path may be applied to any weapon system/firearm with a trigger. The drawings are not intended to be limiting in any sense.

The embodiments were chosen and described in order to best explain the principles of the invention and its practical application to thereby enable others skilled in the art to best utilize the invention in various embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A firearm having a frame with a trigger guard extending from the frame, the trigger guard having and interior surface defining a trigger area with a trigger of the firearm contained in the trigger area, the firearm having a grip positioned relative to the frame to allow a user to grip the firearm with the grip and position a trigger finger of the user in the trigger area, the firearm having a guide path, the guide path comprising a groove formed on the frame of the firearm and extending from a first position that corresponds to an area on a lateral side of the frame of the firearm outside of the trigger area forward of the interior surface defined by the trigger guard to a second position that is in the trigger area adjacent to the trigger, the guide path at the first position being generally aligned on the frame such that the trigger finger of the user is pointed toward a muzzle of the firearm when the user senses the guide path at the first position, the guide path extending from the first position to the second position with a transition from the lateral side of the frame to an underside of the frame without intersecting the trigger guard, the guide path being configured to allow a user of the firearm to sense the guide path with the trigger finger of the user and follow the guide path from the area outside of the trigger area on the frame of the firearm into the trigger area to engage the trigger of the firearm without significant movement of a hand of the user.

2. The firearm of claim 1, wherein the guide path is provided on a right side of the firearm.

* * * * *

UNITED STATES PATENT AND TRADEMARK OFFICE

CERTIFICATE OF CORRECTION

PATENT NO. : 8,713,831 B2
APPLICATION NO. : 13/588743
DATED : May 6, 2014
INVENTOR(S) : David A. Grossman and Jonathon D. Grossman It is certified that error appears in the above-identified patent and that said Letters Patent is hereby corrected as shown below:

In the Claims

In column 4, line 3, replace “and” with -- an --

Signed and Sealed this
Fifteenth Day of July, 2014

Michelle K. Lee

Michelle K. Lee
*Deputy Director of the United States Patent and Trademark Office*